US007040195B1

(12) United States Patent
Lackey et al.

(10) Patent No.: US 7,040,195 B1
(45) Date of Patent: May 9, 2006

(54) ROOF RAKE SYSTEM

(76) Inventors: John P. Lackey, 6400 46th Ave. N. #55, Kenneth City, FL (US) 33709; George R. Asselin, 17606 Sterling Ter., Redington Shores, FL (US) 33708

( * ) Notice: Subject to any disclaimer, the term of this patent is extended or adjusted under 35 U.S.C. 154(b) by 112 days.

(21) Appl. No.: 10/871,253

(22) Filed: Jun. 18, 2004

Related U.S. Application Data

(63) Continuation-in-part of application No. 10/372,461, filed on Feb. 21, 2003, now abandoned.

(51) Int. Cl.
*E04D 15/02* (2006.01)

(52) U.S. Cl. ..... 81/45; 254/21; D8/89

(58) Field of Classification Search ..... 81/45; 254/18, 21, 25, 120; D8/89; 30/172; 52/749.12; 16/426
See application file for complete search history.

(56) References Cited

U.S. PATENT DOCUMENTS

| | | | | | |
|---|---|---|---|---|---|
| 237,891 | A | * | 2/1881 | Musselman | 16/426 |
| 764,401 | A | * | 7/1904 | Wegner | 56/400.04 |
| 1,218,145 | A | * | 3/1917 | Whittier | 81/45 |
| 1,805,289 | A | * | 5/1931 | Kuno | 172/371 |
| D236,872 | S | * | 9/1975 | Froehlich | D8/89 |
| 4,098,506 | A | * | 7/1978 | Gaiser | 473/538 |
| 4,664,381 | A | * | 5/1987 | Aaron | 473/551 |
| 4,890,679 | A | * | 1/1990 | Jacobs | 172/371 |
| 5,280,676 | A | * | 1/1994 | Fieni | 30/172 |
| 5,447,289 | A | * | 9/1995 | Callahan | 254/131 |
| D392,867 | S | * | 3/1998 | Gracy et al. | D8/89 |
| 5,733,204 | A | * | 3/1998 | Carrara | 423/300 |
| 5,836,222 | A | * | 11/1998 | Harpell | 81/45 |
| 5,971,653 | A | * | 10/1999 | Harpell | 403/97 |
| 6,412,569 | B1 | * | 7/2002 | Webb | 172/371 |

* cited by examiner

*Primary Examiner*—Debra S Meislin
(74) *Attorney, Agent, or Firm*—Edward P. Dutkiewicz

(57) ABSTRACT

A roof rake system comprises a handle having an upper end and a lower end. A head has an interior region, an exterior region, and an intermediate region. The interior region securely receives the lower end of the handle. The exterior region is cylindrically shaped over the majority of its extent as an extension of the intermediate region and with a free end. A flat plate is in a rectangular configuration with a leading edge adjacent to the free end and a long trailing edge adjacent to the intermediate. A plurality of broad V-shaped projections are at the leading edge of the plate forming laterally spaced crests with laterally spaced roots there between. The intermediate region is curved with the exterior region and plate being in a plane and located entirely beneath the lower end of the handle during operation and use.

5 Claims, 6 Drawing Sheets

FIG 3
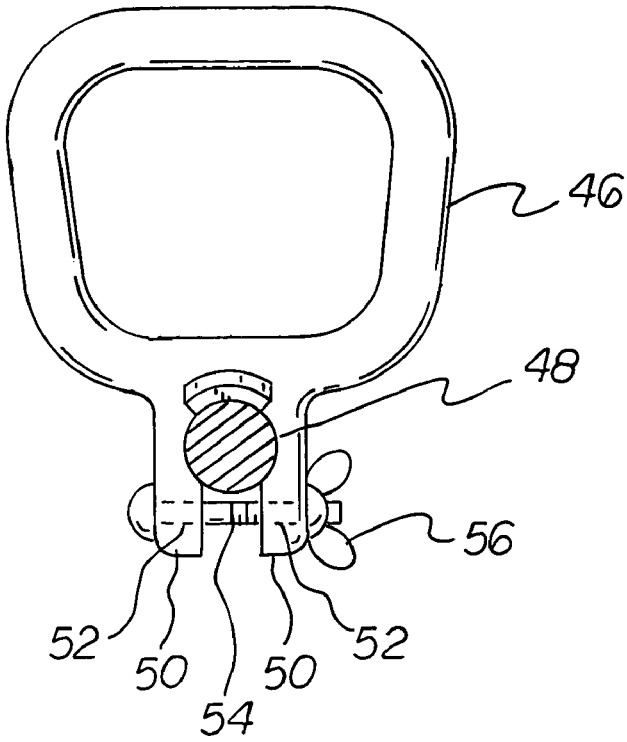
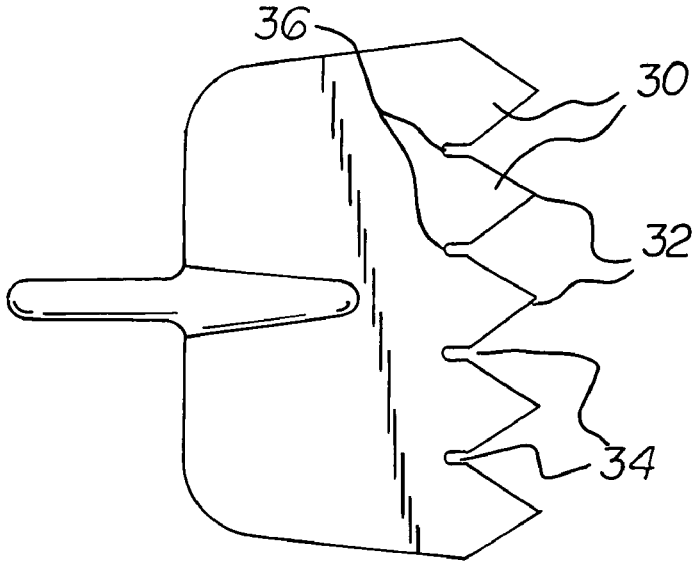
FIG 4

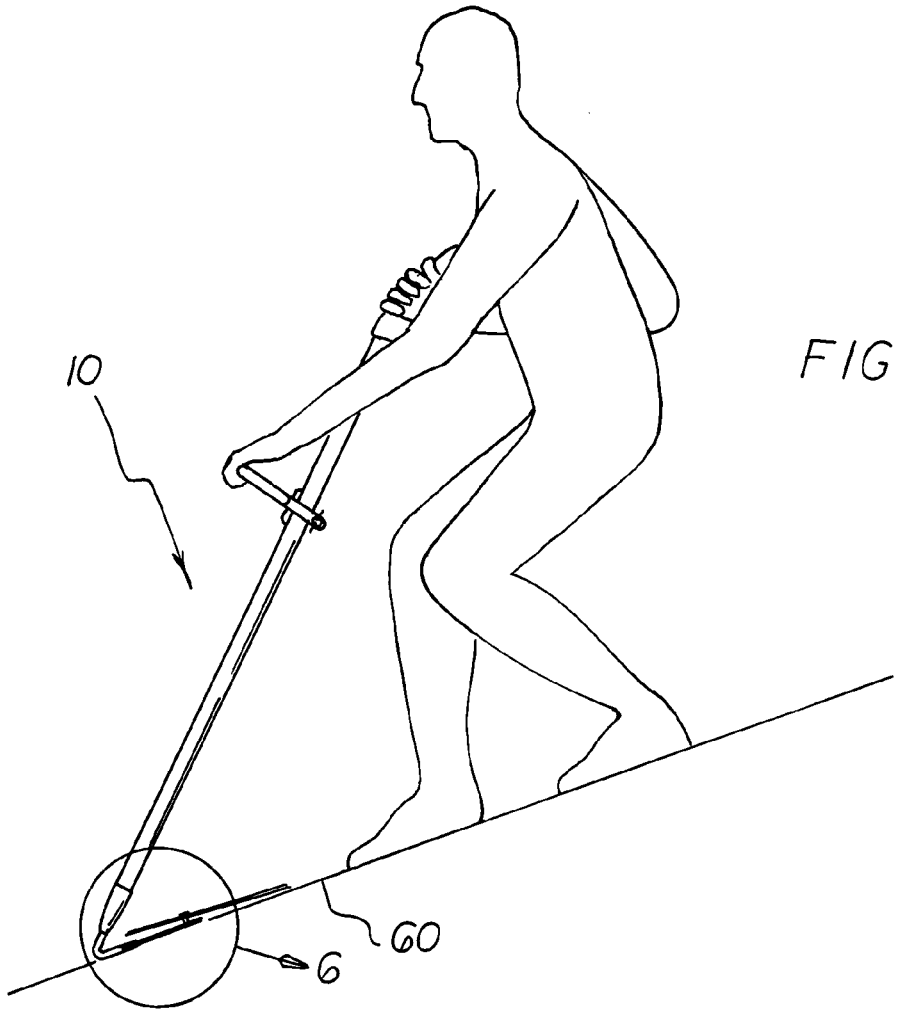
FIG 5
FIG 6
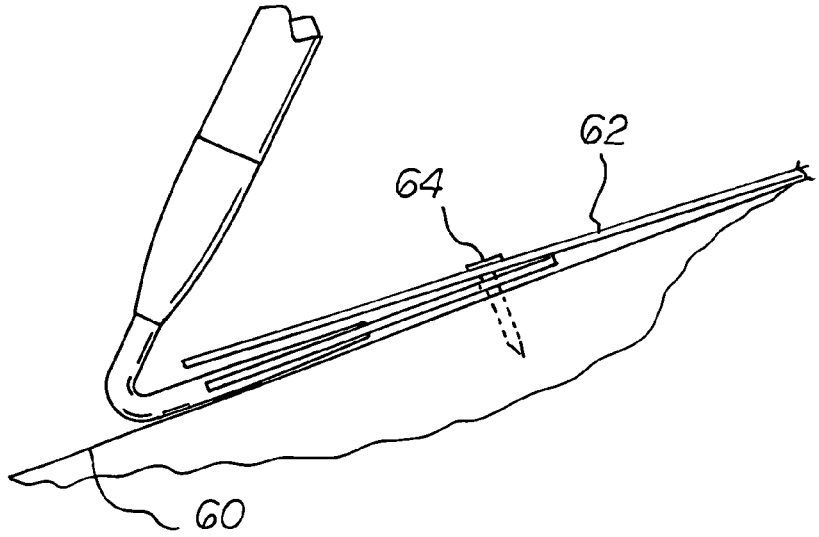

FIG 9
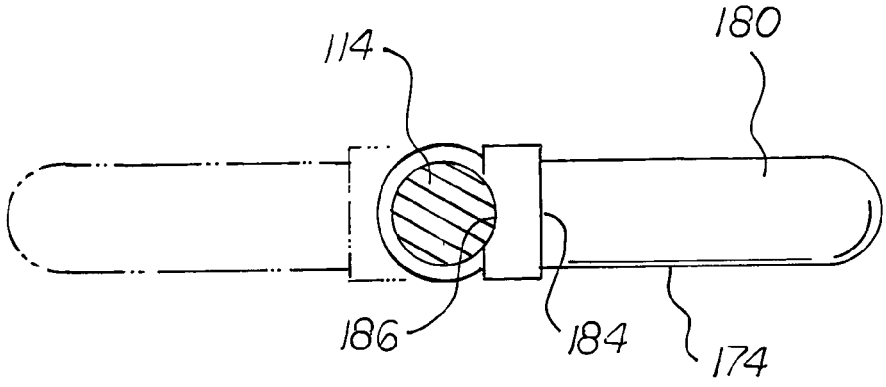
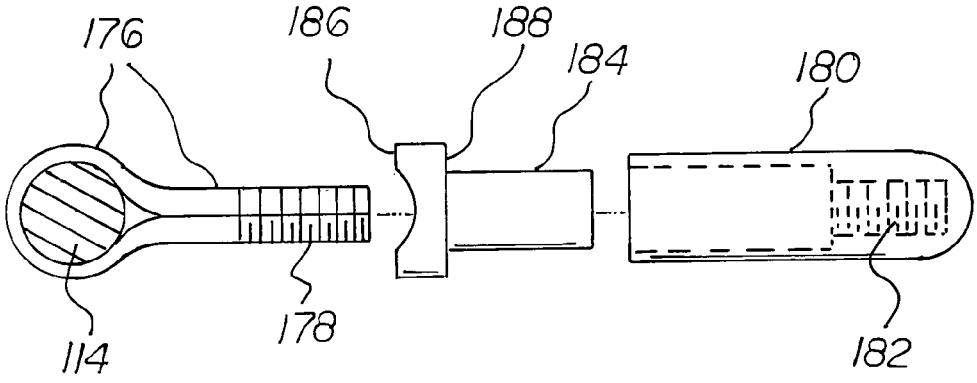
FIG 10

ROOF RAKE SYSTEM

RELATED APPLICATION

The present patent application is a continuation-in-part application of U.S. patent application Ser. No. 10/372,461 filed Feb. 21, 2003, now abandoned.

BACKGROUND OF THE INVENTION

1. Field of the Invention

The present invention relates to a roof rake system and more particularly pertains to pulling shingles and nails from roofs in a safe and convenient manner.

2. Description of the Prior Art

The use of devices of known designs and configurations for removing nails and the like is known in the prior art. More specifically, devices of known designs and configurations for removing nails and the like previously devised and utilized for the purpose of removing unwanted shingles and nails through conventional methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,447,289 to Callahan discloses a pry shovel tool for wooden pallet deck board removal. U.S. Pat. No. D391,867 to Gracy et al discloses a multi-purpose wrecking bar. U.S. Pat. No. 5,280,676 to Fieni discloses an apparatus for removing shingles and nails from a roof. U.S. Pat. No. 4,086,699 to Olkkola discloses a roof stripping tool. Lastly, U.S. Pat. No. 4,477,972 to Testa, Jr. discloses a tool for use in stripping shingles.

While these devices fulfill their respective, particular objectives and requirements, the aforementioned patents do not describe a roof rake system that allows pulling shingles and nails from roofs in a safe and convenient manner.

In this respect, the roof rake system according to the present invention substantially departs from the conventional concepts and designs of the prior art, and in doing so provides an apparatus primarily developed for the purpose of pulling shingles and nails from roofs in a safe and convenient manner.

Therefore, it can be appreciated that there exists a continuing need for a new and improved roof rake system which can be used for pulling shingles and nails from roofs in a safe and convenient manner. In this regard, the present invention substantially fulfills this need.

SUMMARY OF THE INVENTION

In view of the foregoing disadvantages inherent in the known types of devices of known designs and configurations for removing nails and the like now present in the prior art, the present invention provides an improved roof rake system. As such, the general purpose of the present invention, which will be described subsequently in greater detail, is to provide a new and improved roof rake system and method which has all the advantages of the prior art and none of the disadvantages.

To attain this, the present invention essentially comprises a rigid handle. The handle is in a generally cylindrical configuration. The handle has an upper end. The upper end faces generally upwardly. The handle also has a lower end. The lower end faces generally downwardly during operation and use. The lower end is formed in a generally cone shaped configuration. The handle has a length being between 4 feet and 5 feet, preferably 4.5 feet. The handle has a central axis along its entire length. The handle is fabricated of wood.

Provided next is a rigid head. The head is fabricated of steel. The head has an interior region and an exterior region. An intermediate region is provided between the interior and exterior regions. The interior region is hollow. The interior region is provided in a generally cone shaped configuration. The interior region securely receives the lower end of the handle. The exterior region is cylindrically shaped over the majority of its extent as an extension of the intermediate region with a free end formed with a taper facing the interior region.

Next provided is a flat plate in a rectangular configuration with a long leading edge adjacent to the free end of the exterior region and a long trailing edge adjacent to the intermediate region and with short parallel side edges there between. The flat plate has a bottom face and a top face with a weld coupling the exterior region of the head to the top face of plate.

A plurality of broad V-shaped projections are at the leading edge of the plate forming laterally spaced crests with laterally spaced roots there between. A plurality of narrow V-shaped projections are at the trailing edge of the plate forming laterally spaced crests with laterally spaced roots there between. The intermediate region has a circular cross-sectional configuration and is curved with a radius of curvature of about 0.50 inches thus forming an angle of between about 40 degrees and 50 degrees. The exterior region and plate are in a plane and located entirely beneath the lower end of the handle during operation and use. The crests of the broad V-shaped recesses are adapted to receive a nail of a roof where after a user may pivot the system around the intermediate region of the head to remove the nail. The crests of the narrow V-shaped recesses are adapted to receive a nail of a roof where after a user may pivot the system around the free end of the plate to remove the nail. The taper of the exterior edge is adapted to lift a shingle when a nail is about to be received by a broad V-shaped recess sliding in contact there with.

A primary grip is next provided. The primary grip is in an ergonomic curved shape and is removably received by the upper end of the handle. It is fabricated of a semi-rigid elastomeric material.

Lastly provided is a secondary grip fabricated of a rigid material, preferably a metal. It has a loop portion positionable around an intermediate extent of the handle with semi-cylindrical sections having male threads. The secondary grip also has a grasping portion with internal female threads receiving the male threads. The secondary grip also has a tubular portion with an exterior face adapted to be pushed towards, and contacted by, the handle through the grasping portion and an interior face adapted to contact the handle for securement purposes.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved roof rake system which has all of the advantages of the prior art devices of known designs and configurations for removing nails and the like and none of the disadvantages.

It is another object of the present invention to provide a new and improved roof rake system which may be easily and efficiently manufactured and marketed.

It is further an object of the present invention to provide a new and improved roof rake system which is of durable and reliable constructions.

An even further object of the present invention is to provide a new and improved roof rake system which is susceptible of a low cost of manufacture with regard to both materials and labor, and which accordingly is then susceptible of low prices of sale to the consuming public, thereby making such roof rake system economically available to the buying public.

Even still another object of the present invention is to provide a roof rake system for pulling shingles and nails from roofs in a safe and convenient manner.

Lastly, it is an object of the present invention to provide a new and improved roof rake system which comprises a handle having an upper end and a lower end. A head has an interior region, an exterior region, and an intermediate region. The interior region securely receives the lower end of the handle. The exterior region is cylindrically shaped over the majority of its extent as an extension of the intermediate region and with a free end. A flat plate is in a rectangular configuration with a leading edge adjacent to the free end and a long trailing edge adjacent to the intermediate. A plurality of broad V-shaped projections are at the leading edge of the plate forming laterally spaced crests with laterally spaced roots there between. The intermediate region is curved with the exterior region and plate being in a plane and located entirely beneath the lower end of the handle during operation and use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross-sectional view taken along line 3—3 of FIG. 1.

FIG. 4 is a cross-sectional view taken along line 4—4 of FIG. 2.

FIG. 5 is a side elevational view of the roof rake system of the prior Figures and illustrating the operation and use of the present invention.

FIG. 6 is an enlarged side elevational view taken at circle 6 of FIG. 5.

FIG. 9 is a cross sectional view taken along line 9—9 of FIG. 7.

FIG. 10 is an exploded view, partly in section, of the secondary handle shown in FIG. 9.

The same reference numerals refer to the same parts throughout the various Figures.

DESCRIPTION OF THE PREFERRED EMBODIMENT

Figure 1:
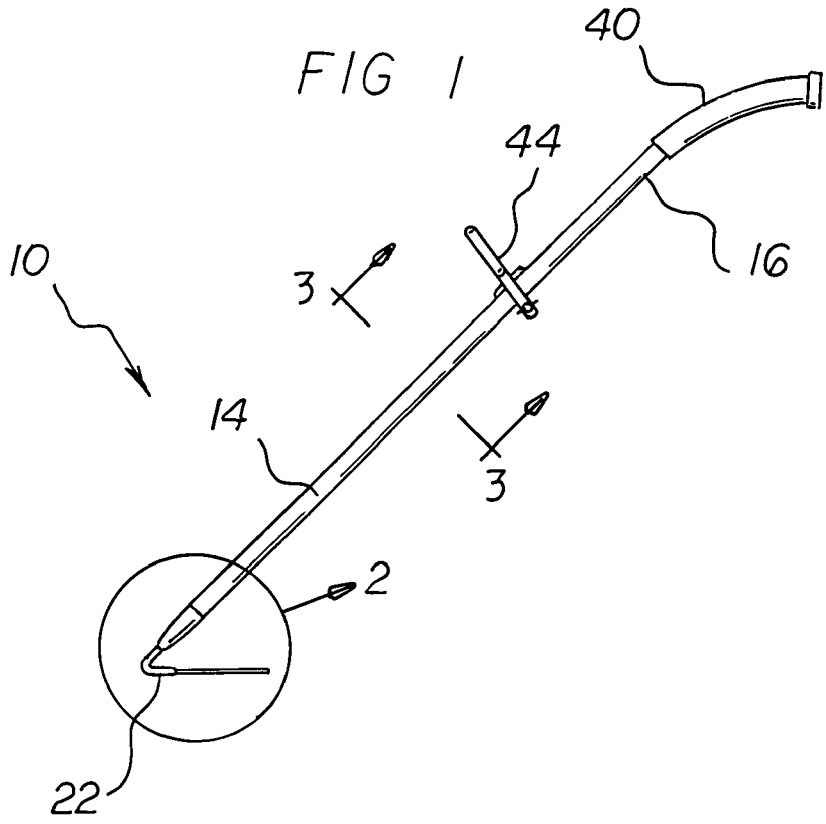
FIG. 1 is a side elevational view of a roof rake system for pulling shingles and nails from roofs in a safe and convenient manner and constructed in accordance with the principles of the present invention.
Figure 2:
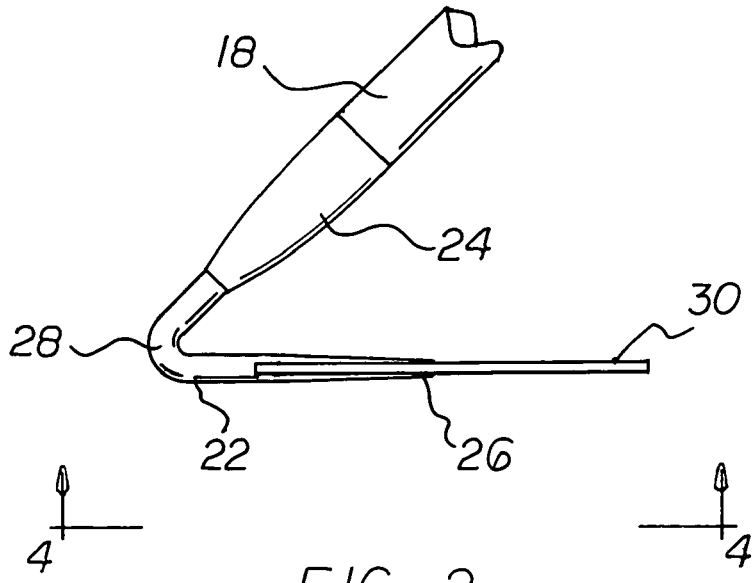
FIG. 2 is an enlarged side elevational view taken at circle 2 of FIG. 1.
Figure 7:
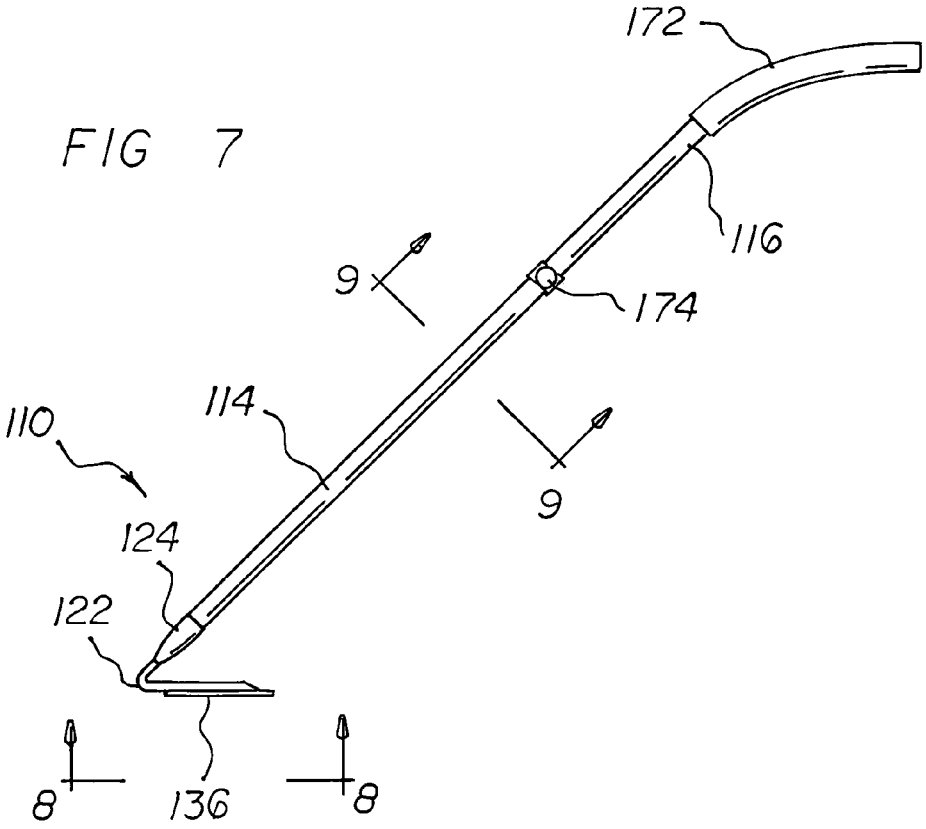
FIG. 7 is a side elevational view of a system constructed in accordance with an alternate embodiment of the invention.
Figure 8:
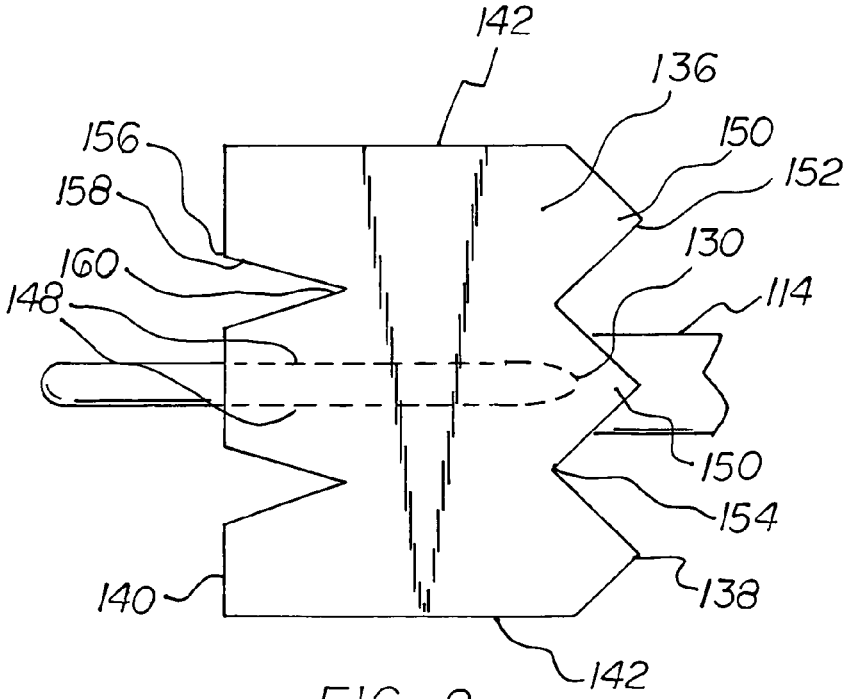
FIG. 8 is a bottom view of the system taken along line 8—8 of FIG. 7.

With reference now to the drawings, and in particular to FIG. 1 thereof, the preferred embodiment of the new and improved roof rake system embodying the principles and concepts of the present invention and generally designated by the reference numeral 10 will be described.

The present invention, the roof rake system 10 is comprised of a plurality of components. Such components in their broadest context include a handle and a head. Such components are individually configured and correlated with respect to each other so as to attain the desired objective.

First provided is a rigid handle 14. The handle is in a generally cylindrical configuration. The handle has an upper end 16. The upper end faces generally upwardly. The handle also has a lower end 18. The lower end faces generally downwardly during operation and use. The lower end is formed in a generally cone shaped configuration. The handle has a length being between 4 feet and 5 feet, preferably 4.5 feet. The handle has a central axis along its entire length. The handle is fabricated of wood.

Provided next is a rigid head 22. The head is fabricated of steel. The head has an interior region 24 and an exterior region 26. An intermediate region 28 is provided between the interior and exterior regions. The interior region is hollow. The interior region is provided in a generally cone shaped configuration. The interior region securely receives the lower end of the handle. The exterior region is shaped into a flat plate-like configuration. The exterior region further has a series of V-shaped projections 30. The V-shaped projections form laterally spaced crests 32. Provided between the laterally spaced crests are laterally spaced roots 34. The roots terminate in U-shaped parallel recesses 36. The intermediate region has a circular cross-sectional configuration. The intermediate region is curved with a radius of curvature of between 0.25 inches and 0.75 inches, preferably about 0.50 inches. The intermediate region further forms an angle of between 40 degrees and 50 degrees, preferably about 45 degrees. During operation and use the exterior region is located in a plane beneath the lower end of the handle.

A primary grip 40 is provided next. The primary grip is provided in an ergonomic curved shape. The primary grip is removably received by the upper end of the handle. The primary grip is fabricated of a semi-rigid elastomeric material.

Further provided is a secondary grip 44. The secondary grip is fabricated of a semi-rigid elastomeric material. The secondary grip is formed of a major loop 46 for being grasped by a user. The secondary grip is also formed of a minor loop 48 for being received by the handle at a region intermediate to the upper and lower ends. The major loop extends upwardly from the handle during operation and use. The minor loop has free ends 50. The free ends have aligned apertures 52. The free ends also have a bolt 54. The bolt is positioned through the apertures. A wingnut 56 is provided on the bolt for tightening the secondary grip on the handle.

Provided last is a roof 60. The roof has a plurality of shingles 62. The shingles are coupled to the roof with nails. The exterior end of the head portion of the system is positionable between a shingle and the roof. A nail is provided in the recess of the head. In this manner the user may insert the head under the shingle and nail to pull the handle and head toward the user in order to pull the nail and the shingle and separate them from the roof.

An alternate embodiment of the invention is illustrated in FIGS. 7 through 12. In such embodiment, there is a roof rake system 110 for safely and conveniently pulling shingles and nails from roofs. The system comprises, in combination, a rigid handle 114 in a generally cylindrical configuration. The handle has an upper end 116 facing generally upwardly and a lower end 118 facing generally downwardly during operation and use. The lower end is formed in a generally cone shaped configuration. The handle has a length being between 4 feet and 5 feet, with a central axis along its entire length. The handle is fabricated of a rigid material, preferably wood.

Next provided is a rigid head 122 fabricated of a rigid material, preferably steel, with an interior region 124 and an exterior region 126 with an intermediate region 128 there between. The interior region is hollow in a generally cone shaped configuration and securely receiving the lower end of the handle. The exterior region is cylindrically shaped over the majority of its extent as an extension of the intermediate region and with a free end 130 formed with a taper 132 facing the interior region.

A flat plate 136 in a rectangular configuration is next provided. The plate is formed with a long leading edge 138 adjacent to the free end of the exterior region and a long trailing edge 140 adjacent to the intermediate region and short parallel side edges 142 there between. The flat plate has a bottom face 144 a top face 146 with a weld 148 coupling the exterior region of the head to the top face of plate. The plate is preferably about seven inches wide and about six inches long.

A plurality of broad V-shaped projections 150 are at the leading edge of the plate forming laterally spaced crests 152 with laterally spaced roots 154 there between. A plurality of narrow V-shaped projections 156 are at the trailing edge of the plate forming laterally spaced crests 158 with laterally spaced roots 160 there between.

The intermediate region preferably has a circular cross-sectional configuration and is curved with a radius of curvature of about 0.50 inches, thus forming an angle of between about 40 degrees and 50 degrees. The exterior region and plate are in a plane located entirely beneath the lower end of the handle during operation and use. The crests of the broad V-shaped recesses are adapted to receive a nail of a roof where after a user may pivot the system around the intermediate region of the head to remove the nail 164. Note FIG. 11. The crests of the narrow V-shaped recesses adapted to receive a nail of a roof 160 where after a user may pivot the system around the free end of the plate to remove the nail. Note FIG. 12. The taper of the exterior edge adapted to lift a shingle 168 when a nail is about to be received by a broad V-shaped recess sliding in contact there with. Note FIG. 11 again.

A primary grip 172 is in an ergonomic curved shape and is removably received by the upper end of the handle. It is preferably fabricated of a semi-rigid elastomeric material.

Figure 11:
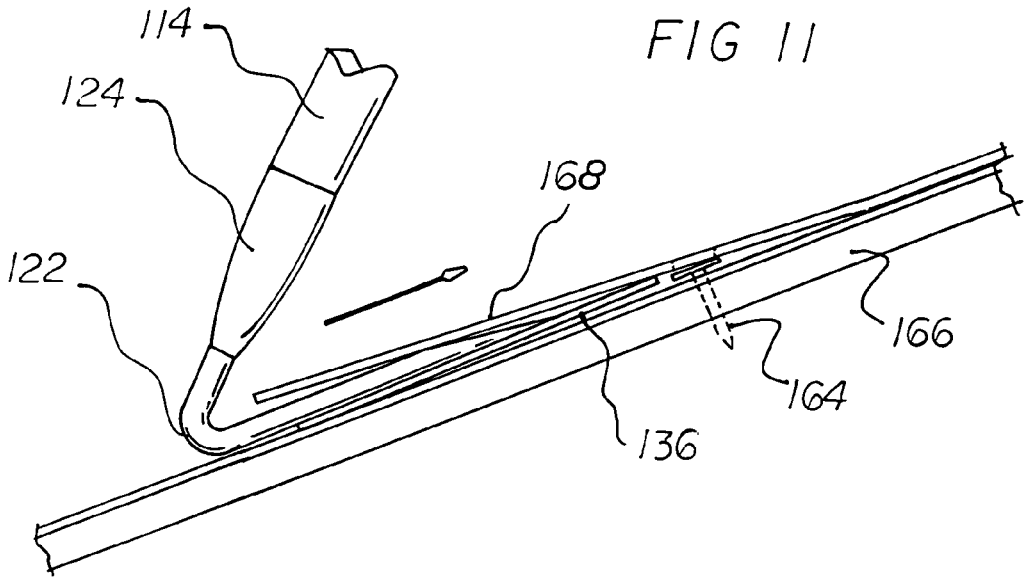
FIG. 11 is an enlarged side elevational view of the bottom portion of the system during operation and use while pulling.
Figure 12:
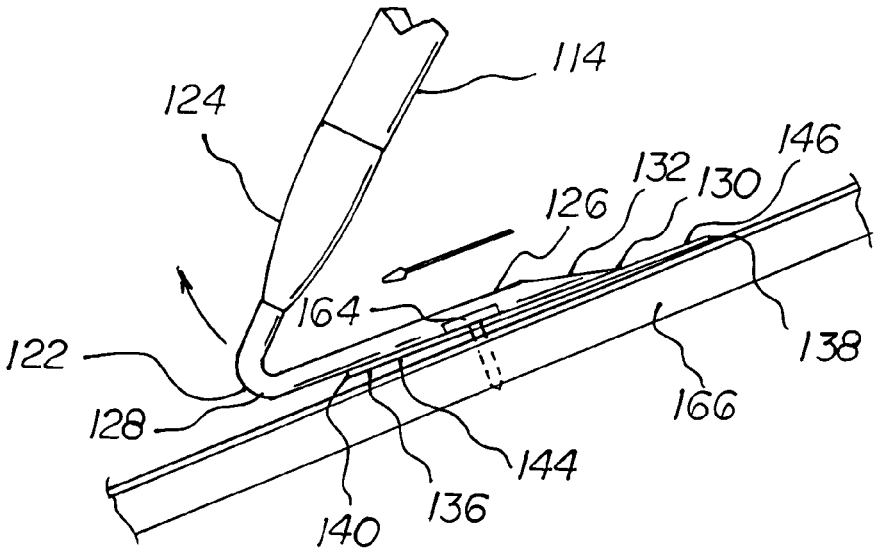
FIG. 12 is an enlarged side elevational view of the bottom portion of the system during operation and use while pushing.

A secondary grip 174 is fabricated of a rigid material, preferably a metal. It has a loop portion 176 positionable around an intermediate extent of the handle with semi-cylindrical sections 178 having male threads 178. The secondary grip also has a grasping portion 180 with internal female threads 182 receiving the male threads. The secondary grip also has a tubular portion 184 with an exterior face 186 adapted to be pushed towards, and contacted by, the handle through the grasping portion and an interior face 188 adapted to contact the handle for securement purposes. The secondary grip may also comprise a T-shaped handle. Note FIGS. 9 and 10. The primary and secondary grips are to be held in the two hands of a user for pushing as illustrated in FIG. 11 and for pulling as illustrated in FIG. 10.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A roof rake system for safely and conveniently pulling shingles and nails from roofs comprising, in combination:

a rigid handle in a generally cylindrical configuration having an upper end facing generally upwardly and a lower end facing generally downwardly during operation and use, the lower end being formed in a generally cone shaped configuration, the handle having a length being between 4 feet and 5 feet, with a central axis along its entire length, the handle being fabricated of a rigid material;

a rigid head fabricated of a rigid material, with an interior region and an exterior region with an intermediate region there between, the interior region being hollow in a generally cone shaped configuration and securely receiving the lower end of the handle, the exterior region being cylindrically shaped over the majority of its extent as an extension of the intermediate region and with a free end formed with a taper facing the interior region;

a flat plate in a rectangular configuration with a long leading edge adjacent to the free end of the exterior region and a long trailing edge adjacent to the intermediate region and short parallel side edges there between, the flat plate having a bottom face and a top face with a weld coupling the exterior region of the head to the top face of plate;

a plurality of broad V-shaped projections at the leading edge of the plate forming laterally spaced crests with laterally spaced roots there between, a plurality of narrow V-shaped recesses at the trailing edge of the plate forming laterally spaced crests with laterally spaced roots there between, the intermediate region having a circular cross-sectional configuration and being curved with a radius of curvature of about 0.50 inches, and forming an angle of between about 40 degrees and 50 degrees, with the exterior region and plate being in a plane and located entirely beneath the lower end of the handle during operation and use, the crests of the broad V-shaped recesses adapted to receive a nail of a roof where after a user may pivot the system around the intermediate region of the head to remove the nail, the crests of the narrow V-shaped recesses adapted to receive a nail of a roof where after a user may pivot the system around the free end of the plate to remove the nail, the exterior region having a taper adapted to lift a shingle when a nail is about to be received by a broad V-shaped recess sliding in contact there with;

a primary grip in an ergonomic curved shape removably received by the upper end of the handle and fabricated of a semi-rigid elastomeric material; and a secondary grip fabricated of a rigid material and having a loop portion positionable around an intermediate extent of the handle with semi-cylindrical sections having male threads, the secondary grip also having a grasping portion with internal female threads receiving the male threads, the secondary grip also having a tubular portion with an exterior face adapted to be pushed towards, and contacted by, the handle through the grasping portion and an interior face adapted to contact the grasping portion for securement purposes.

2. A roof rake system comprising:

a handle having an upper end and a lower end;

a rigid head with an interior region and an exterior region with an intermediate region there between, the interior region securely receiving the lower end of the handle, the exterior region being cylindrically shaped over the majority of its extent as an extension of the intermediate region and with a free end;

a flat plate in a rectangular configuration with a leading edge adjacent to the free end and a long trailing edge adjacent to the intermediate region; and a plurality of broad V-shaped projections at the leading edge of the plate forming laterally spaced crests with laterally spaced roots there between, the intermediate region being curved, with the exterior region and plate being in a plane and located entirely beneath the lower end of the handle during operation and use.

3. The system as set forth in claim 2 and further including a plurality of additional V-shaped projections at the trailing edge of the plate forming laterally spaced crests with laterally spaced roots there between.

4. The system as set forth in claim 2 and further including a primary grip in an ergonomic curved shape removably received by the upper end of the handle.

5. The system as set forth in claim 2 and further including a secondary grip having a loop portion positionable around an intermediate extent of the handle with semi-cylindrical sections having male threads, the secondary grip also having a grasping portion with internal female threads receiving the male threads, the secondary grip also having a tubular portion with an exterior face adapted to be pushed towards, and contacted by, the handle through the grasping portion and an interior face adapted to contact the grasping portion for securement purposes.

* * * * *